US005191985A

United States Patent [19]

Licari

[11] Patent Number: 5,191,985

[45] Date of Patent: Mar. 9, 1993

[54] MODULAR SUPPORT AND DISPLAY UNIT

[76] Inventor: Yaffa Licari, 875 Ocean Ave., Elberton, N.J. 07740

[21] Appl. No.: 826,281

[22] Filed: Jan. 6, 1986

Related U.S. Application Data

[63] Continuation of Ser. No. 567,394, Dec. 30, 1983.

[51] Int. Cl.[5] ..... A47B 47/00

[52] U.S. Cl. ..... 211/188; 211/194

[58] Field of Search ..... 211/188, 189, 194, 195; 206/503, 513, 518; 220/6, 339

[56] References Cited

U.S. PATENT DOCUMENTS

| | | | |
|---|---|---|---|
| 2,684,766 | 7/1954 | Blom | 206/503 X |
| 3,246,828 | 4/1966 | Branscum et al. | 220/6 X |
| 3,283,915 | 11/1966 | Maslow | 211/183 X |
| 3,611,994 | 10/1971 | Bailey et al. | 220/6 X |
| 3,874,546 | 4/1975 | Sanders et al. | 220/6 |
| 3,923,187 | 12/1975 | Johansson | 206/503 X |
| 4,163,495 | 8/1979 | Drader | 220/6 X |
| 4,225,038 | 9/1980 | Egly | 220/339 X |

*Primary Examiner*—Blair M. Johnson

[57] ABSTRACT

A plastic modular support and display unit whose three sides and base are in grid or lattice form comprising intersecting bars with interstices therebetween; a flexible hinge joining the sides and base; the sides having a plurality of ridges or extensions adjacent the upper edge thereof; the base having a plurality of slots or recesses in undersides, said extensions and recesses being of substantially similar dimensions to provide for a snap fit or friction fit when joined whereby one modular unit may be stacked upon another through the joinder of the extensions on the top of the side walls in one unit within the recesses in the underside of the base in another unit; said units being shippable nested together in inverted form or U-shape; and a cover member for the top of the unit or the top of the stack comprising a plastic grid or lattice with slots or recesses in the underside thereof to be stack fitted or frictionally fitted to the extensions on the top edge of the side walls.

18 Claims, 4 Drawing Sheets

MODULAR SUPPORT AND DISPLAY UNIT

FIELD OF THE INVENTION

This is a continuation of copending U.S. Application Ser. No. 567,394 filed Dec. 30, 1983 and now abandoned.

This invention relates to a modular construction for a support and display structure. The structure may be transported in partially assembled form occupying minimal space to thereby substantially reduce shipping costs and is easy to assemble into a utilitarian unit.

BACKGROUND OF THE INVENTION

Heretofore there have been suggestions for providing support units in the form of a table, rack or the like on which publications such as magazines and books, files, pictures and various other articles can be placed to provide ready access thereto. Usually these units are shipped in assembled, large and cumbersome form which not only restricts their use but also makes the transportation costs intolerable.

There has been prior art with suggestions for providing assemblable units in the form of dome structures, finishing panels, building walls and the like. However, no suggestion has been found for the provision of a modular support and display unit whose sides and base are in grid or lattice form having flexible hinges to join the sides and base and connectable together by extensions on the sides interlocking with slots or recesses in the base.

U.S. Pat. No. 3,500,606 shows a flooring assembly in which the rectangular units are maintained together by studs extending through keyhole slots and does not at all deal with vertically extending structures.

U.S. Pat. No. 2,914,815 provides interlocking flooring with a tongue and groove arrangement for placing the units together.

U.S. Pat. No. 2,958,918 provides a dome-like structure in which the pieces are fitted together by projections on one fitting into recesses on the other and which are required to be braced in order to be maintained in position.

U.S. Pat. No. 3,286,423 suggests hooklike members nesting against each other to accomplish a connection between the building walls.

U.S. Pat. No. 1,980,906 provides metal tiling with extensions fitting into recesses in a stack relationship one on the other without hinging or any other feature.

U.S. Pat. No. 876,985 shows a screw stud fitting into a recess as a lock joint for wall slabs.

U.S. Pat. No. 1,912,416 discloses lugs projecting from one side of a flange to be interlocked into recesses on the other side.

U.S. Pat. No. 982,029 shows ornamental tile with interfitting relations between slots and recesses but does not at all suggest a modular support of the construction of the present invention.

SUMMARY OF THE INVENTION

The present invention relates to a unique and novel support and display unit which overcomes the problems of prior art structures. The new and improved support and display structure includes a body which has at least two sides and a base. The sides and base preferably comprise a grid or lattice produced from moldable plastic such as polypropelene. The grid or lattice is formed of intersecting cross members having interstices therebetween.

An integral unit comprising both the sides and the base is provided by a connecting hinge which extends between the lower edges of the side portions and two parallel sides of the base. The hinge is flexible and the material utilized has a memory. It may be characterized as a "living" hinge.

A relatively narrow plastic strip extends around the entire perimeter of the base. A plurality of spaced slots or recesses are provided in the undersides of the strip which extends along two side edges of the base which are parallel to each other.

A plurality of spaced ridges or extensions are located along the top edges of the side walls. These spaced extensions and the recesses disposed in the underside of the strips on the base are so dimensioned as to provide a snap fit, frictionally maintaining the extensions in the recess when they are engaged with each other.

A cover member for the unit is provided for forming a unitary complete module. The cover member is also formed plastic grid on lattice. A relatively narrow strip extends around its entire perimeter. The undersides of two parallel side edges of the strip are provided with a plurality of slots or recesses.

The integral base and side members may be shipped in disassembled or knock-down form. In a space saving and consequent expense saving manner the base and side walls of a unit are inverted and nested together with the inverted base and side walls of other units forming a substantially inverted form or U-shaped group.

To assemble the module into a storage and display unit only very simple procedures are required with no special tools. The unit is placed on its base and the side walls are raised around the "living" hinge into a vertical position in which walls extend parallel to each other from the base. The cover member is placed over the spaced extensions on top of the side walls and the extensions are pressed into the spaced recesses disposed along the undersides of two parallel sides of the cover member. As aforesaid, the recesses and extensions are so constructed that the extensions may be snap-fitted or otherwise engaged in the recess and frictionally maintained thereto. A self-supporting support and display unit is thereby accomplished.

In accordance with the invention it is possible to form a highly desirable stacking arrangement in which two or more modular units are vertically joined without requiring additional components or laborious assemblage. To accomplish this beneficial stacking arrangement it is only required that the side walls of the bottom unit be raised to a vertical position and to place the base of another unit thereover. Then press the extensions on the top edges of the side walls into the recesses disposed along the undersides of the strip extending around the base of another integral modular unit. This procedure of stacking assemblage can be continued with as many units as is geometrically feasible. When the desired number of units is arranged the cover member may be placed over the uppermost modular unit in the manner described hereinbefore.

The invention will be hereinafter described with reference to an exemplary embodiment thereof. However, it will be understood that this detailed description is to facilitate an understanding of the invention and is not a limitation thereof.

DETAILED DESCRIPTION OF THE INVENTION

Figure 1:
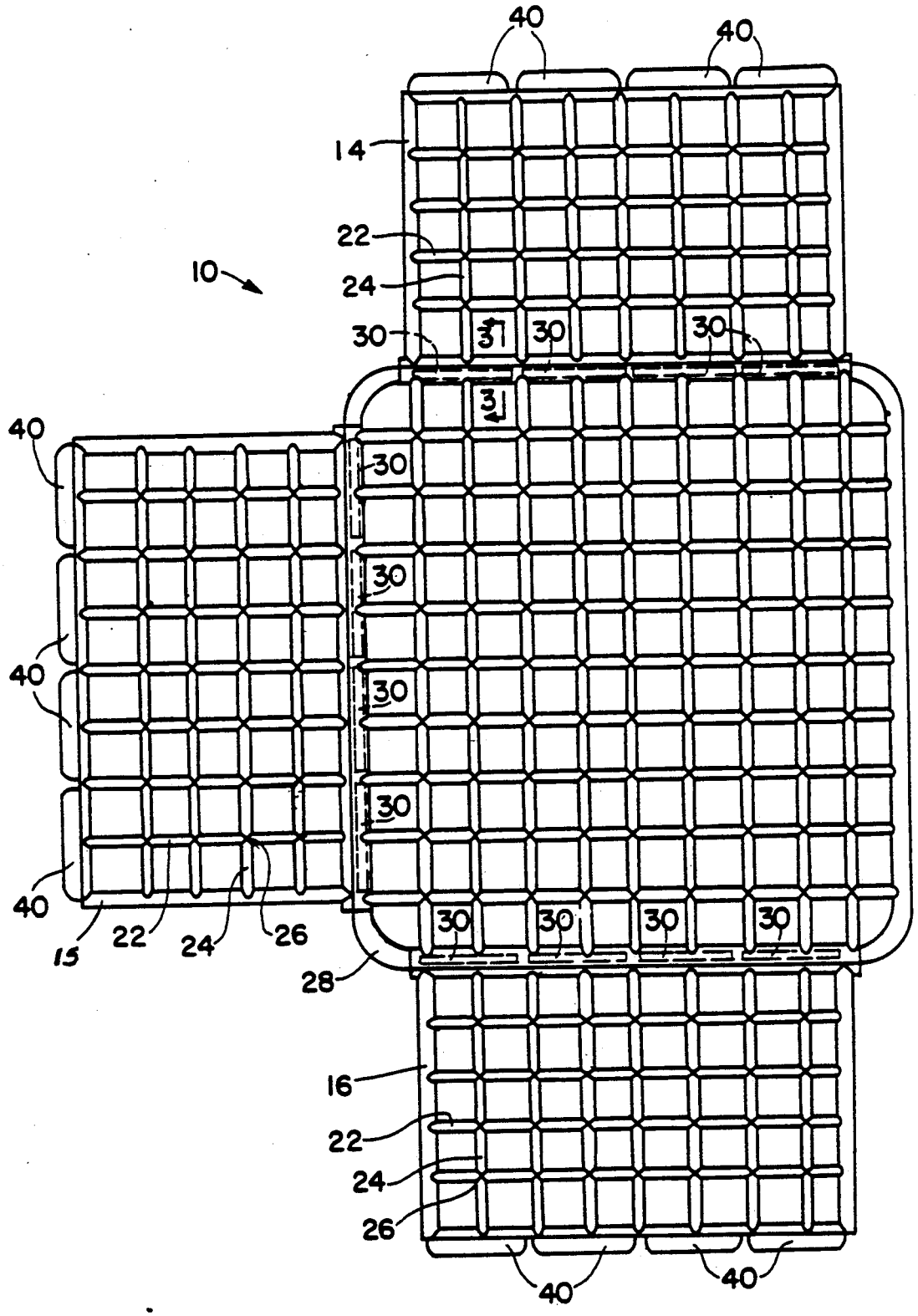
FIG. 1 a plan view of the support and display unit of present invention in collapsed position.

As shown in the drawings, the storage and display unit 10 of the present invention comprises an integral body structure which includes a base 12 and side walls 14, 15 and 16 extending from the base. Flexible or "living" hinges 18 and 20 permanently connect the base 10 to each of the side walls 14, 15 and 16. While three side walls are illustrated, the structure may comprise only two parallel side walls and a base.

FIG. 1 illustrates the unit 10 in its collapsed molded condition prior to being shaped into condition for shipping or assemblage. It is to be noted that the base 10 and sidewalls 14, and 16 are of plastic and preferably in the form of a grid or lattice. The lattice is formed by a plurality of horizontal and vertical bars, generally designated 22 and 24 which intersect each other providing interstices 26 therebetween. This structure provides for complete visibility of the interior of the unit.

The base 10 has a plastic strip 28 around its perimeter. At least one, and preferably a plurality of slots or recesses 30 are disposed in the underside portions of the strip extending along those edges 32 and 34 which are parallel to each other.

The upper or outer free edges 36, 37 and 38 of the side walls 14, 15 and 16 respectively have at least one and preferably a plurality of ridges or extensions 40. The outer diameter of the extensions 40 are of similar dimensions as the inner diameter of the recesses 30

A cover member 42 is provided of similar dimensions as the dimensions of the base 12 and has a strip 44 extending around its perimeter. The undersides of at least two parallel sides of the strip 44 are provided with at least one, and preferably a plurality of slots or recesses 46. The inner diameter of the recesses 46 are also of similar dimensions as the outer diameter of the extensions 40. The term "similar dimensions" as used in this connection shall mean any dimensions which are sufficient to provide a snap-fit or a frictional engagement between the extensions and recesses when they are joined.

No extraordinary skills or physical agility is required to assemble the module 10 which is one of the distinct advantages of the present invention. All that is required is to pivotably raise the side walls 14, 15 and 16 around the hinges 18 and 20 to the vertical position shown in FIG. 2. The cover 42 may then be placed over the top edges 36, 37 and 38 of the side walls 14, 15 and 16 with the extensions 40 aligned with the recesses 30. As a result of the dimensional similarity between the extensions and the recesses a friction or snap-fit is accomplished. The unit is then self-contained and self-supporting comprising two open and two closed sides, or alternatively one open and three closed sides, plus a base and a cover.

The lattice or grid-like walls of the support device provides visible access to any item placed in the module which can be easily viewed from any vantage point. Furthermore, the unit is sturdy and not easily damaged as a result of its unique structure. The unit may be cleaned with facility as there are no inaccessible corners or crevices.

Another distinct advantage of the present invention provided by the structure is that two or more units may be vertically joined together for any desired purpose without in any way requiring additional components or special assembly tools.

Figure 2:
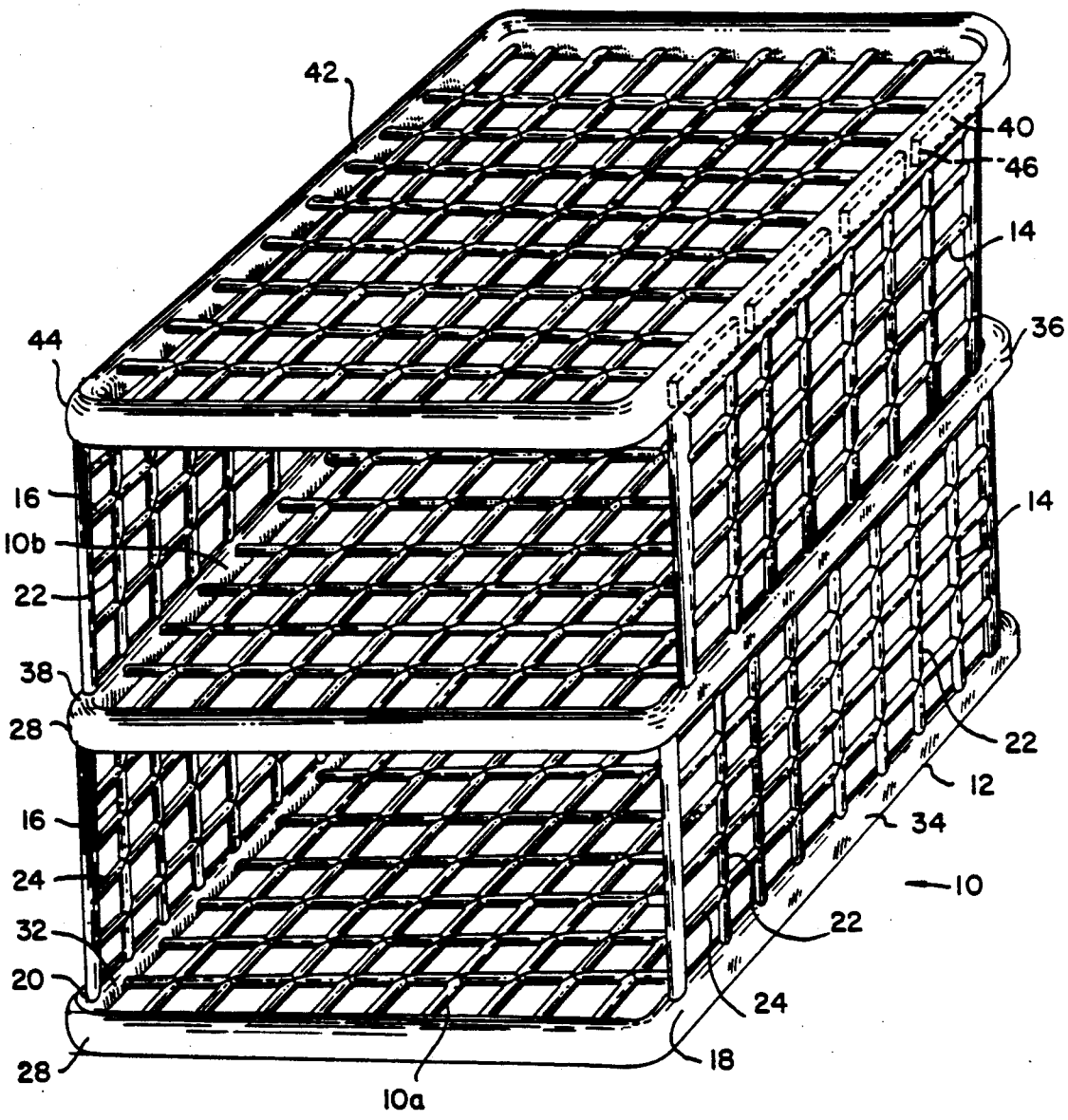
FIG. 2 is a perspective view of two support and display units in a vertically stacked arrangement.

To accomplish this result it is only required to raise the side walls 14, 15 and 16 of the bottom unit **10*a* as illustrated FIG. 2 and then locate the base 12 of another unit above said side walls with the extensions 40 of the side walls 14, 15 and 16 in the bottom unit being aligned with recesses 30 provided in the base of the upper unit 10*b*. As a result of the dimensional similarity between the outer diameter of the extensions 40 and the inner diameter of the recesses 30** a snap-fit or other type of frictional fit is accomplished therebetween when pressed together.

The vertical assemblage of other modular units may be accomplished by following the aforesaid procedures until any desired number of units are in the stack.

When the desired number of units have been vertically assembled, the cover member 42 is placed over and connected to the top edges 36, 37 and 38 of the side walls of the uppermost unit. This provides an integral structure containing several vertically stacked modular units.

The structure of the means for joining the base of one unit to the side walls of another or the cover member to the side walls has been described and illustrated with extensions on the top edges of the side walls and recesses in the base. It will be understood however that this illustrative example is not to be construed as a limitation on the invention and that the joining means may be reversed with the recesses in the strip around the top edges of the side walls and the extensions on the base or cover member.

All portions of the contents of each of the units in the stacked group are visible from any point around the exterior. Thus the unit functions to support any desired article within the feasible limits of the structure and also serves as a means for displaying any article supported therein.

Figure 3:
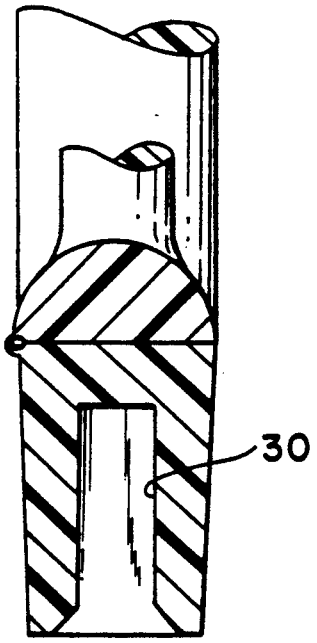
FIG. 3 s a sectional view taken along the lines 3—3 of FIG. 1.
Figure 4:
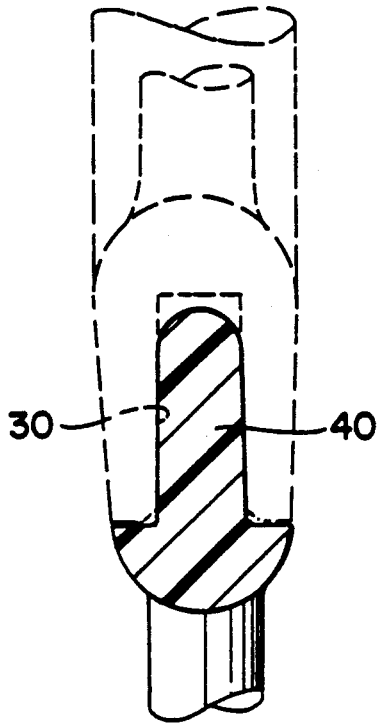
FIG. 4 is a sectional view showing the connection between the base of one storage and display unit and the top side edges of another.
Figure 5:
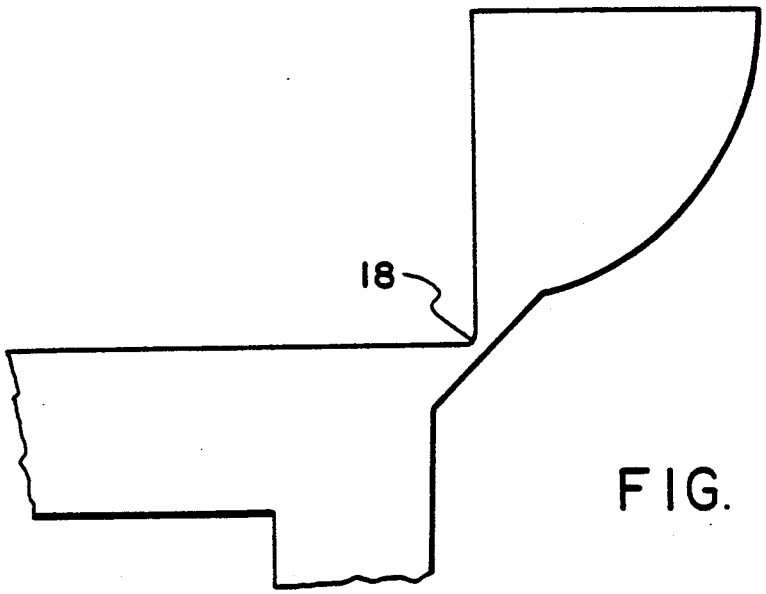
FIG. 5 is a perspective view of the hinge connection between the base and the side walls.
Figure 6:
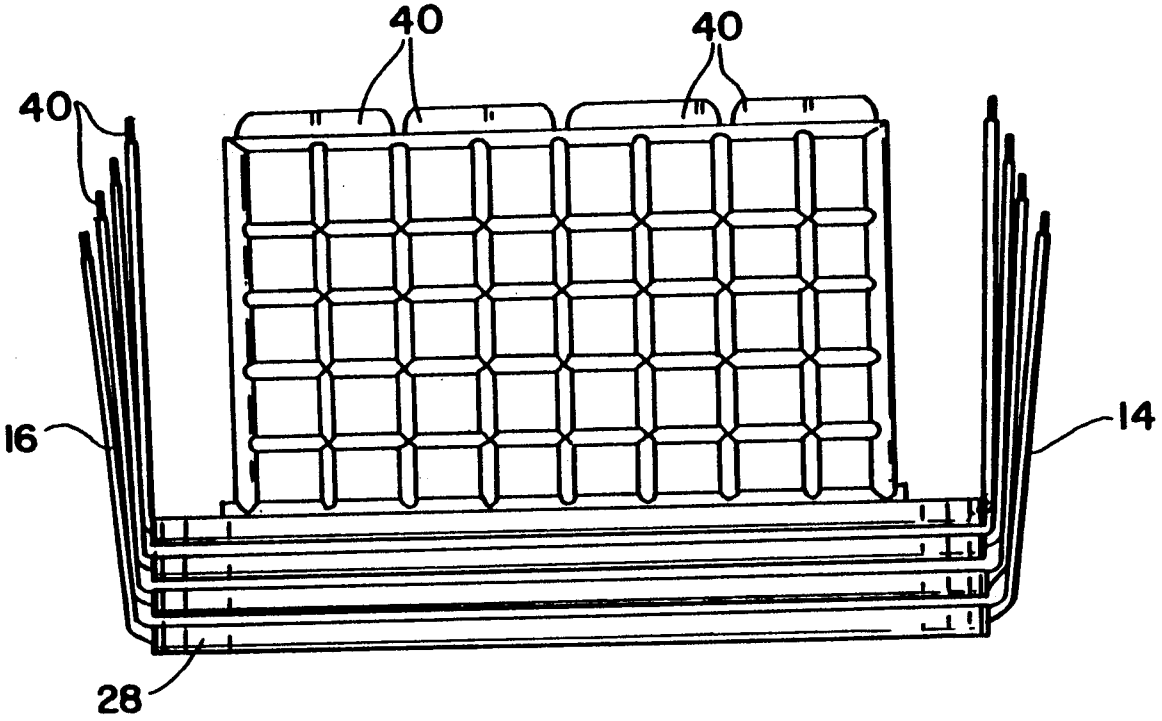
FIG. 6 is a perspective view of nested storage and display units in disassembled form for shipping.

Another distinct advantage to the present invention is the savings of space and expense in the shipment of the unit. For shipment purposes each unit is formed into a substantial U-shape with the legs of the U being spread apart. The material of the hinge is endowed with a "memory" and this position is maintained As illustrated in FIG. 6 the units are nested in inverted a substantially U-shaped form. This nesting arrangement saves enormous amounts of shipping space over that which would be consumed if the units were pre-assembled before shipment. The unique construction provided by the present invention accomplishes this desired result. The shape of the unit also makes the assemblage easier as it suggests the final shape of the module to the user. As is clear from FIGS. 3 and 5, the integral plastic flexible hinges 18 and 20 of a given unit 10 are each disposed between the bottom edge of the corresponding side wall nd the top side of the generally horizontal base and arranged in laterally offset relation thereto at a corresponding lateral boundary surface portion of the bottom edge of the side wall thereat and a corresponding opposed lateral boundary surface portion of the top side of the base thereat, with the hinges being of a reduced thickness relative to the selective thickness of the side walls thereat and relative to the selective thickness of the base thereat and correspondingly arranged adjacent the base recesses, or base extensions, as the case may be, such that a corresponding hinge integrally permanently connects a corresponding said side wall to the base for movement of the side walls relative to the base from an outward generally flat horizontal position in generally horizontal alignment with the base (FIG. 1) to an upward generally vertical position generally normal to the base (FIGS. 2 and 6), while permitting the counterpart wall extensions, or wall recesses, as the case may be, of another or second unit 10 therebelow to be connected thereto in snap-fit relation at the underside base recesses, or base extensions, of the first mentioned unit 10 without hindrance from the disposition of the corresponding hinge in adjacent relation to the base recess, or base extension, thereat of the first mentioned unit or to the corresponding counterpart wall extensions, or wall recesses, of such second unit (FIGS. 2 and 4).

While the invention has been described in detail the description is not a limitation of the invention whose scope is defined through the following claims.

I claim:

1. Stackable one-piece integral plastic modular support and display unit comprising side walls of selective thickness, each having a top edge and a bottom edge, the bottom edge having a bottom edge lateral boundary surface portion, a generally horizontal base of selective thickness and having a top side and an underside, the top side having opposed corresponding top side lateral boundary surface portions to the bottom edge lateral boundary surface portions of the side walls, a corresponding integral plastic flexible hinge of reduced thickness relative to the thickness of the side walls and relative to the thickness of the base integrally permanently connecting each corresponding said side wall to the base, each said hinge being disposed between the bottom edge of the corresponding side wall and the top side of the base and arranged in laterally offset relation thereto at a corresponding lateral boundary surface portion of the bottom edge of the side wall thereat and at a corresponding opposed lateral boundary surface portion of the top side of the base thereat, for movement of the side walls relative to the base from an outward generally flat horizontal position in generally horizontal alignment with the base to an upward generally vertical position generally normal to the base, and two cooperating joining means comprising modular extensions having an outer surface as first joined means and corresponding modular recesses having an inner surface as second joining means, one of said first and second joining means being provided on the top edges of said side walls and the other of said first and second joining means being provided in the underside of the base and corresponding adjacent the hinges, the outer surface of said extensions being of similar dimensions as the dimensions of the inner surface of said recesses to accomplish a snap fit or friction fit therebetween upon stacking one such unit upon the next.

2. Unit of claim 1 in combination with a cover member provided with counterpart joining means for engaging the joining means on the top edges of said side walls.

3. Unit of claim 1 wherein the side walls and base are of plastic in lattice form.

4. Unit of claim 1 including at least two parallel side walls connected by said hinges to the base, said parallel side walls each having a modular extension on the top edge thereof, said base including at least two parallel sides each having a modular recess in the adjacent underside thereat.

5. Unit of claim 4 including a plurality of spaced modular extensions on said side walls and a plurality of spaced modular recesses in said base.

6. Unit of claim 4 wherein the side walls are latticed comprising intersecting ribs with interstices therebetween.

7. Unit of claim 6 wherein the unit is provided with a U-shape to facilitate shipping.

8. Unit of claim 4 in combination with a separate cover member having an underside and including at least two parallel sides and provided with a counterpart modular recess having said inner diameter in the adjacent underside of said at least two parallel sides of the cover member.

9. Combination of claim 8 wherein the cover member is latticed comprising intersecting ribs with interstices therebetween.

10. Unit of claim 1 including three side walls connected by said hinges to the base, a plurality of modular extensions on the top edge of at least two of said side walls, said base including at least two sides having a plurality of modular recesses in the adjacent underside thereat, in combination with a separate cover member having an underside and including at least two sides provided with counterpart modular recesses having said inner surface in the adjacent underside of said at least two sides of the cover member, and said side walls, base and cover member being latticed.

11. Unit of claim 1 wherein a plurality of modular extensions is provided on the top edges of at least two of said side walls, and the base includes at least two sides provided with a plurality of modular recesses in the adjacent underside thereat, said side walls and said base being latticed.

12. The combination of (a) a stackable plastic modular support and display unit comprising a generally horizontal base portion having a top surface and a bottom surface and side wall means extending vertically upwardly from said top surface of said generally horizontal base portion and including a top edge providing a substantially horizontal surface, first joining means and second joining means engageable with said first joining means, one of said first and second joining means being provided on said substantially horizontal surface at said top edge of said side wall means and the other of said first and second joining means being provided on the bottom surface of said base portion at locations corresponding to the locations of said one of said stackable plastic modular support and display units may be removable attached to each other upon stacking one of said stackable plastic modular support and display units upon another of said stackable plastic modular support and display units, and (b) a substantially planar horizontal cover member, including a top surface and a bottom surface, said bottom surface of said substantially horizontal cover member including third joining means corresponding to said one of said first and second joining means provided on said bottom surface of said generally horizontal base portion at locations corresponding thereto, whereby either a second one of said stackable plastic modular support and display units or said substantially horizontal cover member may be stacked upon said substantially horizontal surface at said top edge of said side wall means.

13. The combination of claim 12 wherein said first joining means comprises modular extensions having an outer surface and said second joining means comprises modular recesses having an inner surface, the outer surface of said modular extensions being of similar dimensions as the dimensions of said inner surface of said modular recesses so as to provide a frictional fit therebetween.

14. The combination of claim 12 wherein said stackable plastic modular support and display unit comprises a one-piece integral plastic modular support and display unit.

15. The combination of claim 12 wherein said side wall means comprises three side wall members including a left side wall member, a right side wall member and a central side wall member.

16. The combination of claim 12 wherein said base portion of said stackable plastic modular support and display unit and said substantially horizontal cover member have a substantially square configuration.

17. The combination of claim 12 wherein said base portion and said side wall means are in the form of a lattice.

18. The combination of claim 12 wherein said first joining means are provided on said substantially horizontal surface at said top edge of said side wall means and said second joining means are provided on the bottom surface of said base portion.

* * * * *

UNITED STATES PATENT AND TRADEMARK OFFICE

CERTIFICATE OF CORRECTION

PATENT NO. : 5,191,985
DATED : March 9, 1993
INVENTOR(S) : Yaffa Licari

It is certified that error appears in the above-indentified patent and that said Letters Patent is hereby corrected as shown below:

On the title page, in the list of Inventor, "Elberton" should read --Elberon--

On the title page, Application No. "826,281" should read --816,281--

Column 2, line 22, after "formed" insert --of a--

Column 4, line 57, after "maintained" insert --.--

Column 4, line 58, "a" should read --or--

Column 5, line 59, "joined" should read --joining--

Column 6, line 65, before "stackable" insert --first and second joining means, whereby a plurality of said--

UNITED STATES PATENT AND TRADEMARK OFFICE

CERTIFICATE OF CORRECTION

PATENT NO. : 5,191,985

DATED : March 9, 1993

INVENTOR(S) : Yaffa Licari

It is certified that error appears in the above-indentified patent and that said Letters Patent is hereby corrected as shown below:

Column 6, line 66, "removable" should read --removably--

Signed and Sealed this

Twenty-third Day of November, 1993

*Attest:*

Bruce Lehman

BRUCE LEHMAN

*Attesting Officer*

*Commissioner of Patents and Trademarks*

US005191985A

REEXAMINATION CERTIFICATE (2381st)

United States Patent [19]

[11] B1 5,191,985

Licari

[45] Certificate Issued Sep. 6, 1994

[54] MODULAR SUPPORT AND DISPLAY UNIT

[75] Inventor: Yaffa Licari, Elberon, N.J.

[73] Assignee: Basic Line Industries Inc., Cliffwood, N.J.

Reexamination Requests:
No. 90/003,168, Aug. 20, 1993
No. 90/003,224, Oct. 25, 1993

Reexamination Certificate for:

| | |
|---|---|
| Patent No.: | **5,191,985** |
| Issued: | **Mar. 9, 1993** |
| Appl. No.: | **826,281** |
| Filed: | **Jan. 6, 1986** |

Certificate of Correction issued Nov. 23, 1993.

[51] Int. Cl.[5] ..... A47B 47/00
[52] U.S. Cl. ..... 211/188; 211/194
[58] Field of Search ..... 211/188, 189, 194, 195; 206/503, 513, 518; 220/6, 339

[56] References Cited

U.S. PATENT DOCUMENTS

| | | | |
|---|---|---|---|
| D. 210,274 | 2/1968 | Wilson . | |
| D. 212,518 | 10/1968 | Hofstetter et al. . | |
| D. 220,014 | 2/1971 | Rome et al. . | |
| D. 221,276 | 7/1971 | Rehrig . | |
| D. 224,393 | 7/1972 | Box . | |
| D. 231,331 | 4/1974 | Stauble . | |
| D. 231,332 | 4/1974 | Stauble . | |
| D. 231,905 | 6/1974 | Rehrig et al. . | |
| D. 231,906 | 6/1974 | Rehrig et al. . | |
| D. 236,168 | 7/1975 | Johnson . | |
| D. 236,804 | 7/1975 | Stauble . | |
| D. 256,809 | 9/1980 | Evenson . | |
| D. 271,545 | 11/1983 | Licari et al. . | |
| D. 273,523 | 4/1984 | DiSesa . | |
| D. 273,524 | 4/1984 | DiSesa . | |
| D. 273,525 | 4/1984 | DiSesa . | |
| D. 273,526 | 4/1984 | DiSesa . | |
| D. 277,798 | 2/1985 | DiSesa . | |
| D. 277,800 | 2/1985 | DiSesa . | |
| D. 278,773 | 5/1985 | Licari et al. . | |
| D. 324,314 | 3/1992 | Licari et al. . | |
| D. 330,635 | 11/1992 | Licari . | |
| 1,676,799 | 7/1928 | Prouty et al. . | |
| 2,897,571 | 8/1957 | Kupchinsky et al. . | |
| 3,079,003 | 2/1963 | Hilsinger, Jr. . | |
| 3,212,646 | 10/1965 | Propst | 211/87 |
| 3,379,315 | 4/1968 | Broadwin . | |
| 3,672,530 | 6/1972 | Bridenstine et al. . | |
| 3,722,704 | 3/1973 | Piretti . | |
| 3,756,581 | 9/1973 | Albertini . | |
| 3,812,977 | 5/1974 | Glassman . | |
| 3,834,324 | 9/1974 | Lang . | |
| 3,860,309 | 1/1975 | Brendgord | 312/351 |
| 3,964,810 | 6/1976 | Murphy . | |
| 3,987,737 | 10/1976 | Smith . | |
| 4,037,750 | 7/1977 | Box | 220/4 B |
| 4,074,810 | 2/1978 | Juergens et al. . | |
| 4,176,747 | 12/1979 | Aho . | |
| 4,192,562 | 3/1980 | Bishoff et al. . | |
| 4,247,004 | 1/1981 | Bird . | |
| 4,287,993 | 9/1981 | Licari . | |
| 4,293,072 | 10/1981 | Hill et al. . | |
| 4,297,795 | 11/1981 | Licari . | |
| 4,334,616 | 6/1982 | Wilson . | |
| 4,372,450 | 2/1983 | Licari et al. . | |
| 4,457,433 | 7/1984 | Wilson . | |
| 4,463,853 | 9/1984 | Licari et al. . | |
| 4,473,155 | 9/1984 | Howitt | 206/505 |
| 4,478,344 | 10/1984 | Rehrig . | |
| 4,488,650 | 12/1984 | Licari . | |
| 4,509,930 | 4/1985 | Schweigert et al. . | |
| 4,538,739 | 10/1985 | Licari et al. . | |
| 4,619,363 | 10/1986 | Wolfseder . | |
| 4,760,921 | 8/1988 | Licari . | |
| 5,152,230 | 10/1992 | Licari . | |

FOREIGN PATENT DOCUMENTS

| | | |
|---|---|---|
| 1062615 | 7/1959 | Fed. Rep. of Germany . |
| 781523 | 8/1957 | United Kingdom . |
| 911272 | 11/1962 | United Kingdom . |
| 2023543 | 1/1990 | United Kingdom . |

OTHER PUBLICATIONS

From the file history of Des. 220,014, a copy of Eldon Industries Inc., Flyer 7-74-119, entitled Eldon Stackable Tray Model #1600.

Color copy of an undated Endon ® Super Stackable ® Tray brochure, showing joined trays on the left hand

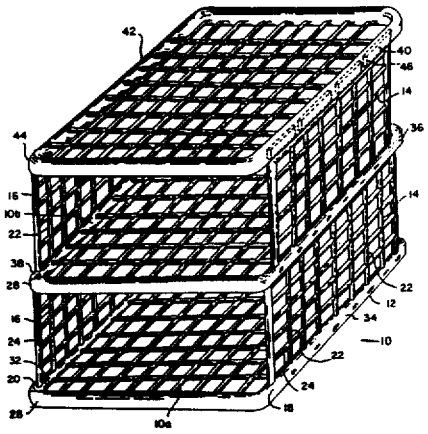

side (Item No. 1604) and two Eldon Data Carts (Item Nos. 1609 and 1610) right hand side.

Color copy of a 1982 copyrighted brochure for the Eldon Legal Stackable® trays (Item No. 1601).

Copy of computer printouts from Thompson & Thompson Trademarkscan database showing USPTO information regarding the Super Stackable® and Data Cart® trademarks—first date of use in commerce—Oct. 17, 1977 (for both).

Copy of Eldon Industries Inc. blueprint for Tray No. 1600, dated Jul. 31, 1968 (Sheet No. 1).

Copy of Eldon Industries Inc. blueprint for Tray No. 1600, dated Jul. 31, 1968 (Sheet No. 2).

Color copy of an Eldon Vertical Sorter package display, copyright 1979, by Eldon Office Products/ division of Eldon Industries, Carson, Calif. 90749.

Copy of assembly instructions from said package for the Eldon No. 1655/1656 Vertical Sorter TM.

Color copy of L. E. Muran Co. Office Supply Catalog, copyright 1981 by CIC, particularly pp. 36, 37, 104, and 448, illustrating several stackable storage products, including the "Rubbermaid Snapstack Trays"—Item Nos. 2521 et seq. (at p. 36); various Eldon Stackables® (at p. 37); the Eldon Catch'all TM —Item No. 1625 (at p. 104); and the Eldon Data Carts (at p. 448).

Color copy of 1982 Curver b.v. Catalog, including dated ('82) cover page, back page and interior p. 5, showing a pair of stackable vegetable storage racks (Item No. 00.5782) and a top shelf (Item No. 00.5783). Also shown is a stackable wine rack (Item No. 00.5781).

Color copy of Curver Catalog for 1973-74—cover page, dated interior cover page and unnumbered interior page illustrating Article No. 04935—a stackable vegetable-fruitrack.

Color copy of Lustroware® 1964 Catalog—cover page and p. 4 illustrating two sizes of frictionally joinable or stackable polyethylene storage bins and substantially flat cover trays, product Nos. B-71, B-72 and B—73.

Color copy of 1983 Sterlite Catalog—cover page and p. 15, illustrating Sterilite Stacking Storage Basket Trolly (Item No. 1539), and Sterlite Stacking Storage Basket (Item No. 1569).

Copy of dated Sterilite price list pages from Jul. 1982, listing the Sterilite Storage Basket Trolly (formerly referred to as Item No. 41569), and Sterilite Stacking Storage Basket No. 1569.

Color copy of photograph illustrating frictionally joinable Sterilite Stacking Baskets, No. 1569.

Color copy of undated Sterilite catalog page illustrating Sterilite Three Basket Storage Cart (Item No. 3301).

Copy of dated Sterilite price list pages from January of 1983, listing Sterilite Three Basket Storage Cart (Item No. 3301, formerly referred to as Total Rak).

Copy of Sterilite Three Basket Storage Cart illustrated assembly instructions.

1981 Rubbermaid housewares catalog or portions thereof (6 pages).

1977 Rubbermaid Home Horticulture Catalog (25 pages).

Feb. 1981 Rubbermaid Office Products Catalog (3 pages).

1975 Eldon Desk Accessories Catalog (5 pages).

*Primary Examiner*—Blair M. Johnson

[57] ABSTRACT

A plastic modular support and display unit whose three sides and base are in grid or lattice form comprising intersecting bars with interstices therebetween; a flexible hinge joining the sides and base; the sides having a plurality of ridges or extensions adjacent the upper edge thereof; the base having a plurality of slots or recesses in undersides, said extensions and recesses being of substantially similar dimensions to provide for a snap fit or friction fit when joined whereby one modular unit may be stacked upon another through the joinder of the extensions on the top of the side walls in one unit within the recesses in the underside of the base in another unit; said units being shippable nested together in inverted form or U-shape; and a cover member for the top of the unit or the top of the stack comprising a plastic grid or lattice with slots or recesses in the underside thereof to be stack fitted or frictionally fitted to the extensions on the top edge of the side walls.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-11 is confirmed.

Claims 12, 13, 15 are cancelled.

Claims 14, 16-18 are determined to be patentable as amended.

New claims 19, 20 are added and determined to be patentable.

14. The combination of claim [12] *19 or 20* wherein said stackable plastic modular support and display unit comprises a one-piece integral plastic modular support and display unit.

16. The combination of claim [12] *19 or 20* wherein said base portion of said stackable plastic modular support and display unit and said substantially horizontal cover member have a substantially square configuration.

17. The combination of claim [12] *19 or 20* wherein said base portion and said side wall means are in the form of a lattice.

18. The combination of claim [12] *19 or 20* wherein said first joining means are provided on said substantially horizontal surface at said top edge of said side wall means and said second joining means are provided on the bottom surface of said base portion.

*19. The combination of*

*(a) a stackable plastic modular support and display unit comprising a generally horizontal base portion having a top surface and a bottom surface and side wall means extending vertically upwardly from said top surface of said generally horizontal base portion and including a top edge providing a substantially horizontal surface, first joining means and second joining means engageable with said first joining means, wherein said first joining means comprises modular extensions having an outer surface and said second joining means comprises modular recesses having an inner surface, the outer surface of said modular extensions being of similar dimensions as the dimensions of said inner surface of said modular recesses so as to provide a frictional fit therebetween, one of said first and second joining means being provided on said substantially horizontal surface at said top edge of said side wall means and the other of said first and second joining means being provided on the bottom surface of said base portion at locations corresponding to the locations of said one of said first and second joining means, whereby a plurality of said stackable plastic modular support and display units may be removably attached to each other upon stacking one of said stackable plastic modular support and display units upon another of said stackable plastic modular support and display units, and*

*(b) a substantially planar horizontal cover member, including a top surface and a bottom surface, said bottom surface of said substantially horizontal cover member including third joining means corresponding to said one of said first and second joining means provided on said bottom surface of said generally horizontal base portion at locations corresponding thereto, whereby either a second one of said stackable plastic modular support and display units or said substantially horizontal cover member may be stacked upon said substantially horizontal surface at said top edge of said side wall means.*

*20. The combination of*

*(a) a stackable plastic modular support and display unit comprising a generally horizontal base portion having a top surface and a bottom surface and side wall means comprising three side wall members including a left side wall member, a right side wall member, and a central side wall member extending vertically upwardly from said top surface of said generally horizontal base portion and including a top edge providing a substantially horizontal surface, first joining means and second joining means grippingly engageable with said first joining means, one of said first and second joining means being provided on said substantially horizontal surface at said top edge of said side wall means and the other of said first and second joining means being provided on the bottom surface of said base portion at locations corresponding to the locations of said one of said first and second joining means, whereby a plurality of said stackable plastic modular support and display units may be removably attached to each other upon stacking one of said stackable plastic modular support and display units upon another of said stackable plastic modular support and display units, and*

*(b) a substantially planar horizontal cover member, including a top surface and a bottom surface, said bottom surface of said substantially horizontal cover member including third joining means corresponding to said one of said first and second joining means provided on said bottom surface of said generally horizontal base portion at locations corresonding thereto, whereby either a second one of said stackable plastic modular support and display units or said substantially horizontal cover member may be stacked upon said substantially horizontal surface at said top edge of said side wall means.*

* * * * *

US005191985A

REEXAMINATION CERTIFICATE (2435th)

United States Patent [19]

[11] B2 5,191,985

Licari

[45] Certificate Issued Nov. 29, 1994

[54] MODULAR SUPPORT AND DISPLAY UNIT

[75] Inventor: Yaffa Licari, Elberon, N.J.

[73] Assignee: Basic Line Industries, Inc., Cliffwood Beach, N.J.

Reexamination Request:
No. 90/003,470, Jun. 21, 1994

Reexamination Certificate for:

| | |
|---|---|
| Patent No.: | **5,191,985** |
| Issued: | **Mar. 9, 1993** |
| Appl. No.: | **816,281** |
| Filed: | **Jan. 6, 1986** |

Certificate of Correction issued Nov. 23, 1993.

Related U.S. Application Data

[63] Continuation of Ser. No. 567,394, Dec. 30, 1983.

[51] Int. Cl.[5] ..... A47B 47/00
[52] U.S. Cl. ..... 211/188; 211/194
[58] Field of Search ..... 211/188, 189, 194, 195, 211/126; 206/503, 513, 518; 220/6, 339

[56] References Cited

U.S. PATENT DOCUMENTS 2,916,161 12/1959 Schaefer .
3,003,839 10/1961 Bloom et al. .
3,606,506 9/1971 Ungaro .

*Primary Examiner*—Blair M. Johnson

[57] ABSTRACT

A plastic modular support and display unit whose three sides and base are in grid or lattice form comprising intersecting bars with interstices therebetween; a flexible hinge joining the sides and base; the sides having a plurality of ridges or extensions adjacent the upper edge thereof; the base having a plurality of slots or recesses in undersides, said extensions and recesses being of substantially similar dimensions to provide for a snap fit or friction fit when joined whereby one modular unit may be stacked upon another through the joinder of the extensions on the top of the side walls in one unit within the recesses in the underside of the base in another unit; said units being shippable nested together in inverted form or U-shape; and a cover member for the top of the unit or the top of the stack comprising a plastic grid or lattice with slots or recesses in the underside thereof to be stack fitted or frictionally fitted to the extensions on the top edge of the side walls.

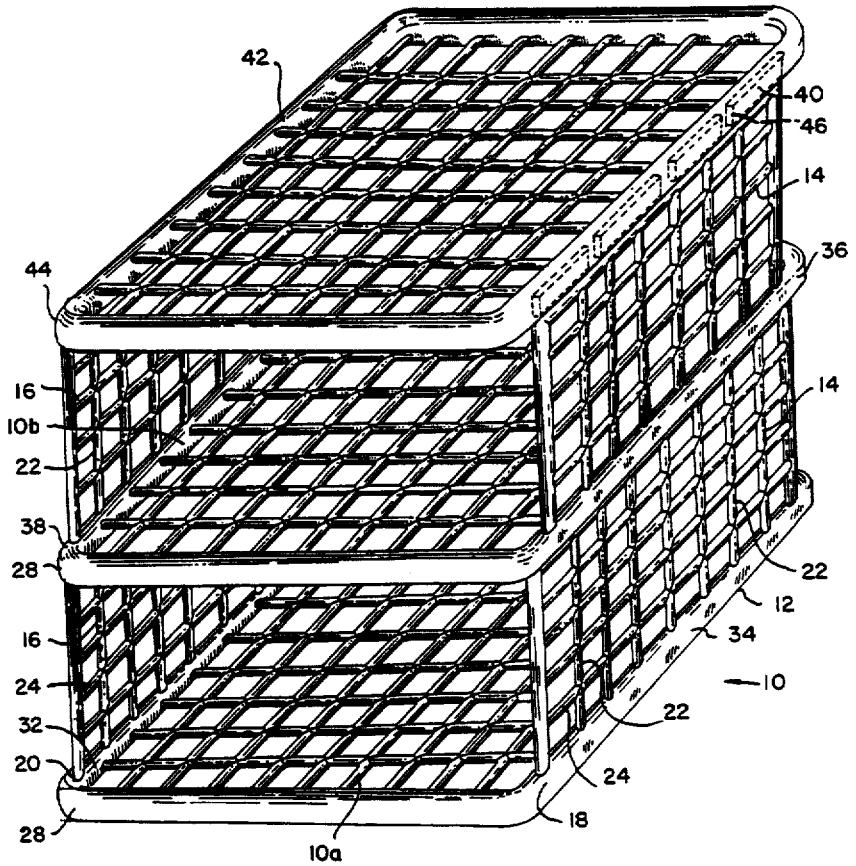

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11, 14 and 16–20 is confirmed.

Claims 12, 13 and 15 were previously cancelled.

* * * * *